US005285940A

United States Patent [19]

Goulter

[11] Patent Number: 5,285,940

[45] Date of Patent: Feb. 15, 1994

[54] FOLDING NECK-SUPPORTED FOOD TRAY

[76] Inventor: Victor H. Goulter, 485 Molimo Dr., San Francisco, Calif. 94127

[21] Appl. No.: 923,469

[22] Filed: Aug. 3, 1992

[51] Int. Cl.[5] ..... A45F 5/00

[52] U.S. Cl. ..... 224/270; 224/148; 224/197; 224/201; 224/265; 2/49.2; 2/903; 108/43; 24/9

[58] Field of Search ..... 224/148, 191, 269, 270, 224/197, 199, 201, 242, 249, 251, 252, 255, 265, 266; 248/311.2, 312.1; 2/49 A; 108/43; 24/3 B, 7, 9

[56] References Cited

U.S. PATENT DOCUMENTS

| | | | |
|---|---|---|---|
| 488,924 | 12/1892 | Kochler | 24/7 |
| 868,817 | 10/1907 | Smith | 24/9 |
| 2,304,705 | 12/1942 | Pate | 224/270 X |
| 2,510,646 | 6/1950 | Meers | 224/270 X |
| 2,550,554 | 4/1951 | Griffin | 224/148 X |
| 3,009,613 | 11/1961 | Noland | 224/270 X |
| 3,541,976 | 11/1970 | Rozas | 108/43 |
| 4,114,199 | 9/1978 | Malan | 2/49 A |
| 4,946,094 | 8/1990 | Stang | 224/270 |
| 5,074,222 | 12/1991 | Welch | 108/43 |

*Primary Examiner*—J. Casimer Jacyna

[57] ABSTRACT

A food tray (40) is pivotally attached on one side (42) to a vertical breast portion (24), which in turn is pivotally attached at it's top end by a bolt and wingnut (22) to a neck hook (29), for hanging the unit on the user's neck. A drinking cup ring (50) is pivotally attached to the center of breast portion (24), for supporting a drinking cup. Two oppositly pivoting arms (30) open outwardly at the top end of breast portion (24) to support a napkin (36) between breast plate (24) and the user, to protect user's clothing. The unit folds up by swiveling arms (30) inwardly, swiveling neck hook (20) downward,, cup ring (50) upward, and breast portion downward into food tray (40). The unit will pack into box 12" ×10"×3" deep.

7 Claims, 5 Drawing Sheets

FOLDING NECK-SUPPORTED FOOD TRAY

BACKGROUND

1. Field of Invention

The present Invention relates to food trays, in particular to a food tray which is supported by the user's neck.

2. Description of Prior Art

Food trays are made in many forms. Most commonly, they comprise a flat rectangular platter with a raised edge all round, often with handles at each end for easy carrying. Some are made of metal and have a raised-up integrally-made edge which facilitates holding and carrying. Still others are made especially for the use of Individuals, and are intended to hold a plate of food and a drinking cup or glass, usually in indented holders shaped to contain them relatively securely. Such food holders or trays are used at parties, picnics, barbecues, and other large gatherings where there are too many guests to seat them at a table.

The problem with trays such as those described is that the user must either find seating or have a place to set the tray down, because it is extremely awkward to simultaneously hold the tray and eat from it. In America, where people often eat with the fork alone, the task is difficult enough, as trays usually cannot be balanced with one hand. For those who use the British system, requiring both hands for the silverware, both holding a tray and eating from it is virtually impossible. Moreover, when a plate is held in one hand while the user attempts to manipulate silverware or food with the other, the balance is so precarious that much spilling takes place.

OBJECTS AND ADVANTAGES

Accordingly, several objects and advantages of the present invention are to provide means 1) to support a plate of food and a glass of drink without the use of the hands; 2) to support a plate of food or drink without need for a table or other surface; 3) to support a plate of food and glass of drink while standing and while keeping the hands free; 4) to provide a means of using both hands to handle silverware while simultanously supporting a plate and a glass or cup; 5) to provide a means by which the user is free to stand or walk or sit at a distance from a table, handling silverware with both hands and simultaneously supporting a plate and glass or cup; 6) to provide a means of keeping the tray and its contents in secure balance so that spilling becomes far less likely.

DESCRIPTION OF THE PREFERRED EMBODIMENT—FIGS. 1-3

Figure 1:
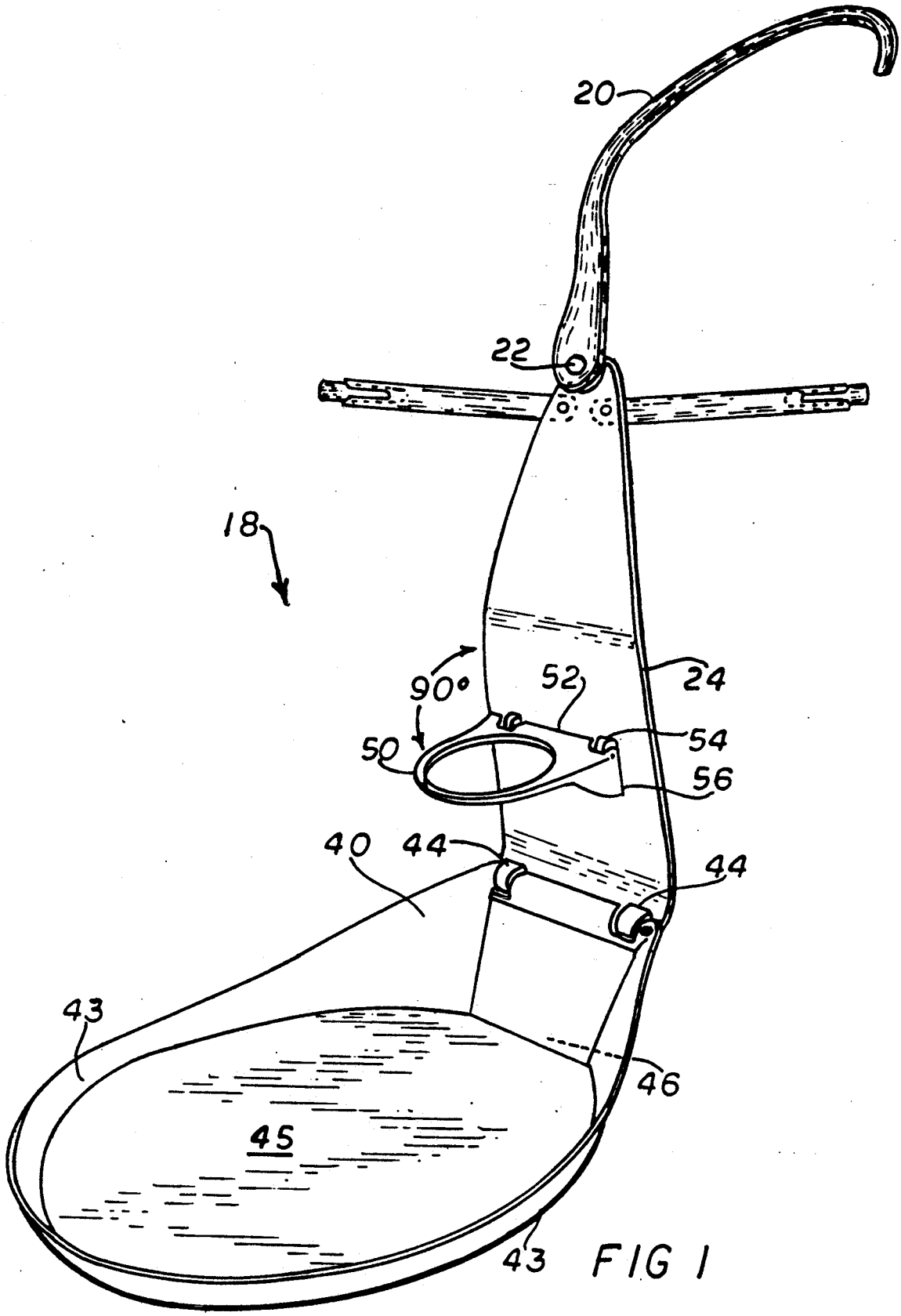
FIG. 1 is a perspective frontal view of the folding neck-supported food tray of the present invention.
Figure 3:
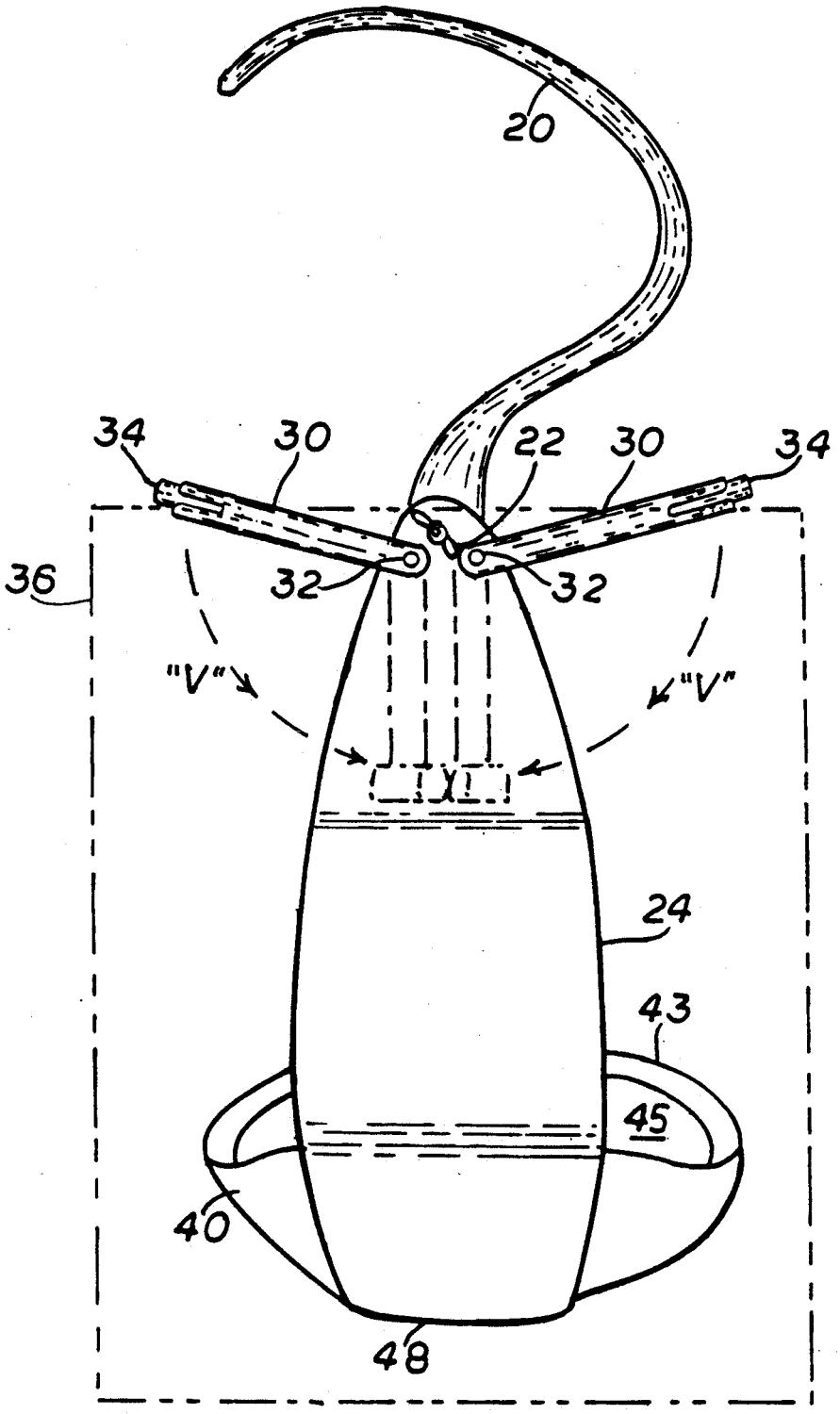
FIG. 3 is a perspective rear view of the food tray shown in FIG. 1 and 2.

Accordingly, FIG. 1 shows a perspective view of a folding neck-supported food tray 18 comprising a neck hook 20, which In use is placed around the back of the user's neck, and which in turn is pivotably and lockably attached to the top of vertical breast portion 24 by a pivot bolt and wingnut 22. Breast portion 24 hangs down in front of the user and has two articulated arms 30 (FIG. 3) which are pivotably and frictionally attached at their proximal ends by rivets 32 or other pivotal means to the back upper end of breast portion 24. Arms 30 are each fitted with a clip 34 or other means, at their distal ends for holding onto the top edge of napkin 36 which is shown In phantom line, (FIG. 3).

Food Supporting Tray

Figure 2:
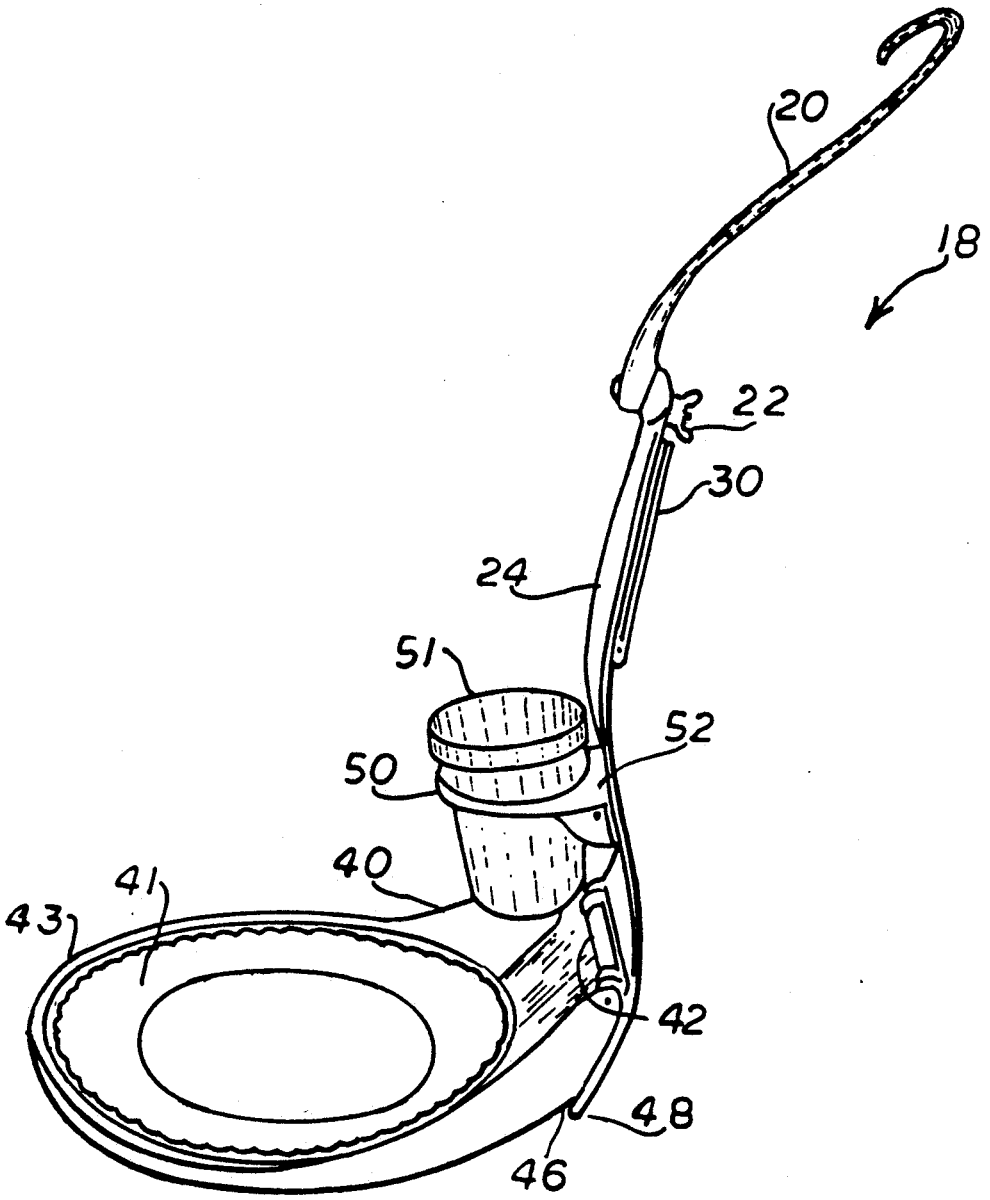
FIG. 2 is a perspective side view of the food tray supporting a food plate and a glass of drink.
Figure 4:
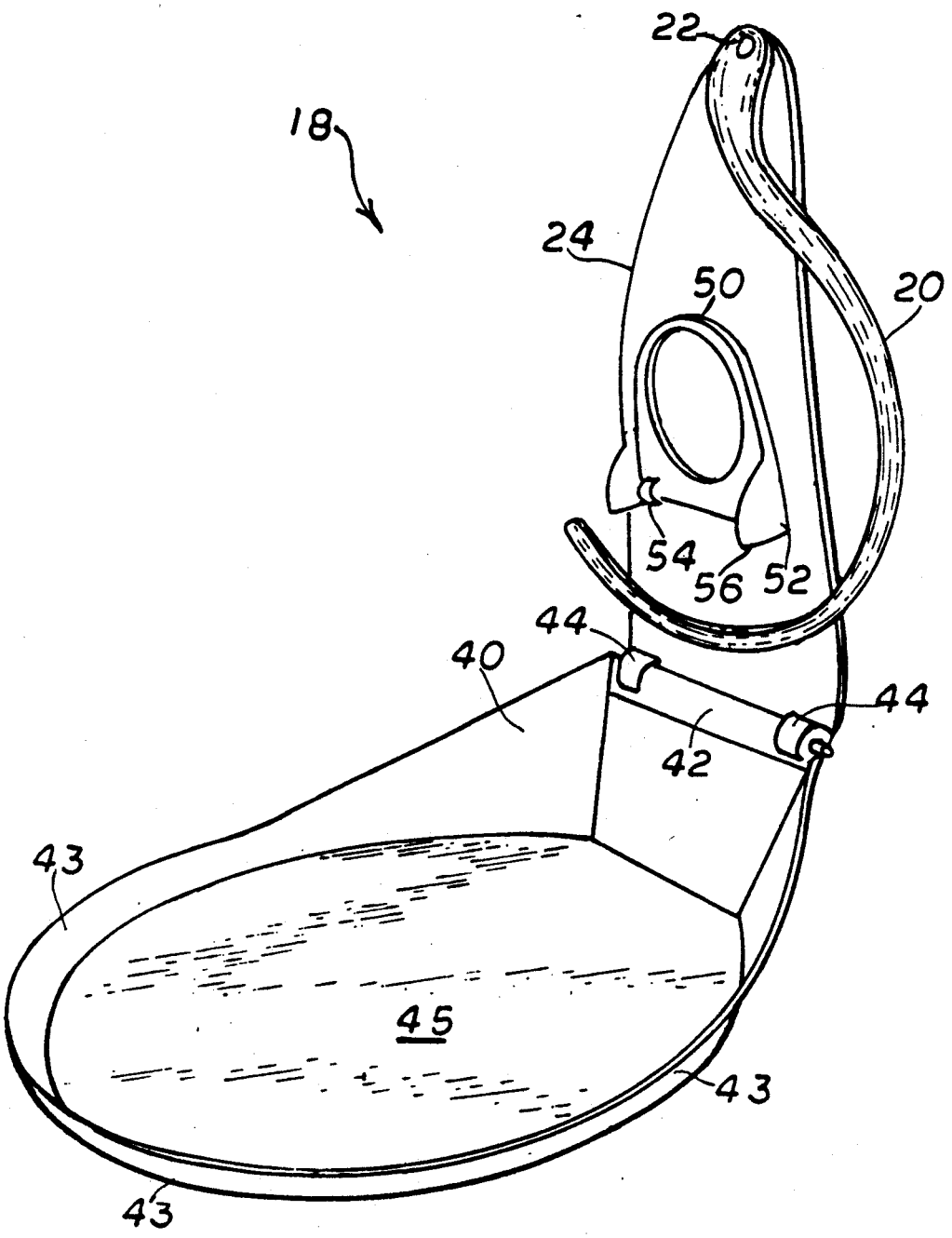
FIG. 4 is a perspective frontal view of the food tray with neck hook, and glass ring folded for packing.

A food supporting tray 40 Is pivotably attached by its rear elevated edge 42, to hinge projections 44 (best seen in FIGS. 1 and 4). These are made integrally with breast portion 24, about 50 mm (2") upward from bottom edge 48 of breast portion 24. In use,, when pivoted tray 40 swivels downward in the direction of arrow "K" (FIG. 5), the lower edge 46 will contact bottom edge 48 of breast portion 24 and the base of tray 40 will remain in a horizontal position for supporting a plate of food (FIG. 2 and 3).

Hinged Drinking Cup or Glass Ring

Positioned about midway down breast portion 24, a pivoted circular cup or drinking glass ring 50 projects outwardly at about ninety degrees to breast portion 24 when in its unfolded position (FIG. 1). Its edge 52 Is hinged to projections 54, which are made Integrally with breast portion 24. When ring 50 swivels downward in the direction of arrow "S" (FIG. 5), stop 56 abuts against the front surface of breast portion 24 (FIGS. 1 and 2), thereby locating ring 50 in a horizontal position for holding a glass or cup 51 (FIG. 2) in a very convenient and safe location.

Also, should any liquid spill from the glass, due to carelessness or accident, the liquid will fall Into tray 40, and some may also be absorbed by napkin 36 (FIG. 3). Thus carpets, floors, and the user's clothing can be saved from being stained.

Food Supporting Tray

Tray 40, as described above, is hinged along its elevated edge 42, and abuts its lower edge 46 against bottom edge 48 of breast portion 24. This provides strength and rigidity for tray 40, yet allows tray 40 to easily fold up for packing and shipping. Front and side raised edges 43 of tray 40 are made with shallow sides about 12 mm (0.5") high, which allows a 230 mm (9") plate 41 to fit within sides 43 or just the base of a larger 280 mm (11") plate (not shown) to be positioned in the tray's cavity 45, yet have its edges protruding over the tray's side and front raised edges 43. Thus cavity 45 and edges 43 prevent either a small or large plate of food from slipping off tray 40. This design also keeps the width of the unit down to a minimum to facilitate manufacturing, using, packing, and shipping.

Folding the Food Tray—FIGS. 3-6

Figure 5:
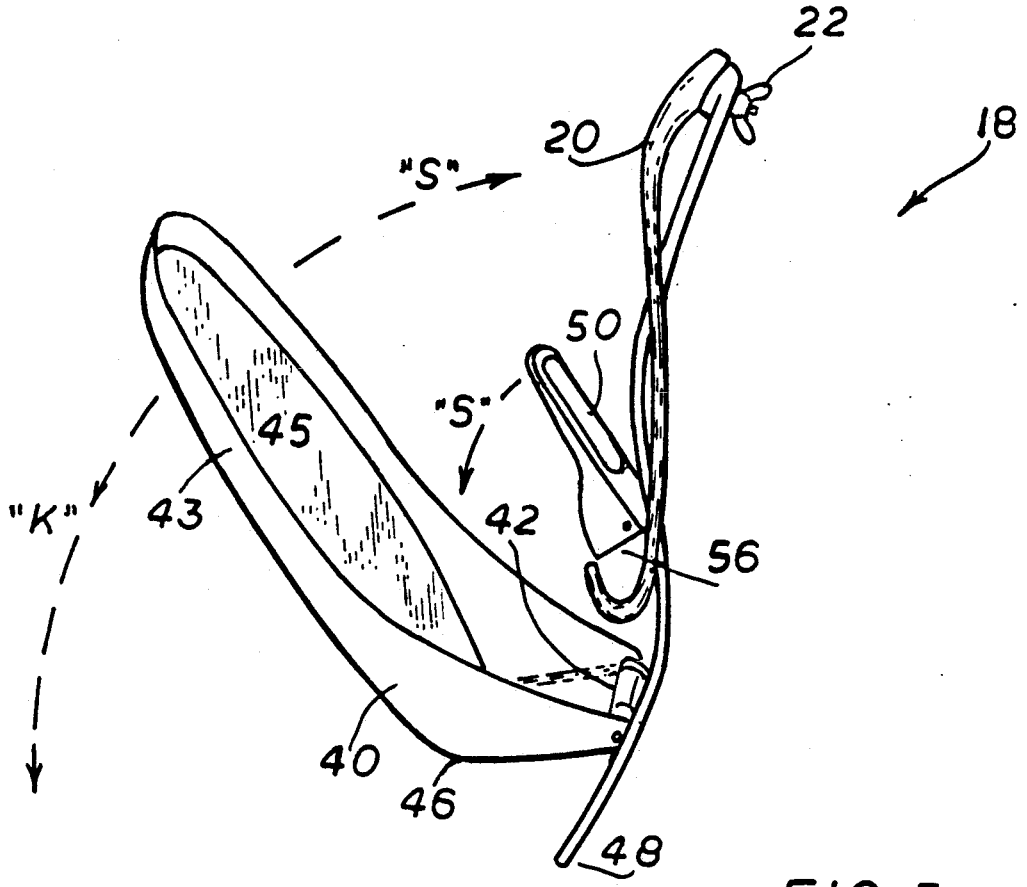
FIG. 5 is a perspective side view of the food tray partly folded.
Figure 6:
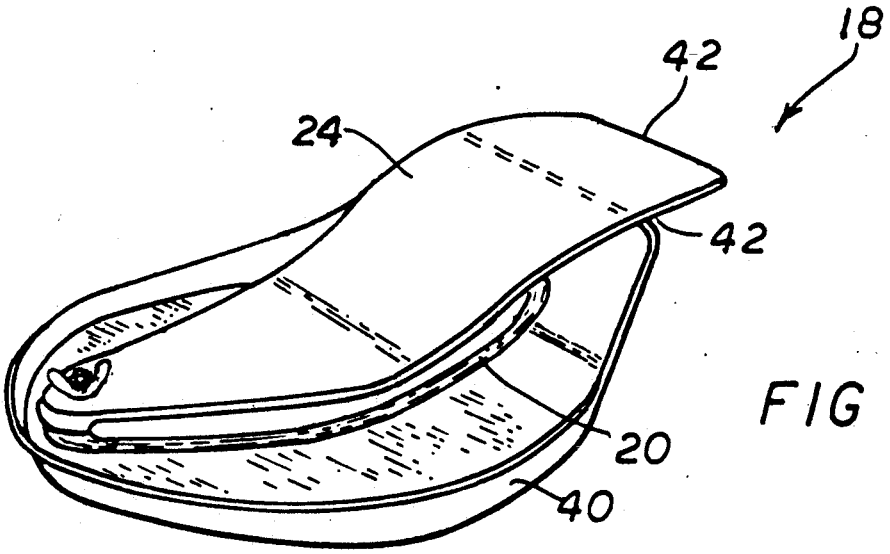
FIG. 6 is a perspective frontal view showing the food tray completely folded for packing.

FIG. 3 shows the first step used in folding the unit. First, remove napkin 36, then fold napkin support arms 30 downward to about a vertical position in the direction of arrow "V"; (FIG. 3) due to friction Joint at rivets 32 between arms 30 and breast portion 24, arms 30 will remain in the folded position. FIG. 4 shows the next two steps: loosen wingnut 22 and swivel neck hook 20 down and around and locate it in front of breast portion 24; then lift cup ring 50 upward and rest it against breast portion 24. FIGS. 5 and 6 show the final step: lift food tray support upward, in the direction of arrow "S" or alternatively fold breast portion downward until food tray and breast portion come together.

The folded unit will now easily pack Into a box measuring 300 mm (12")×250 mm (10")×80 mm (3") deep.

The unit is unfolded in the opposite order.

Preferred Manufacturing Materials

Preferably, the folding food tray and breast portion should be made from aluminum sheet metal, and the neck hook from aluminum tubing. The complete unit can also be made from plastics by Injection molding, or by fiber reinforced polyurethane, fiberglass, carbon fibers etc. Any suitable material can be used in its manufacture.

The unit is self balancing due to the light end being hung around the users neck at the top, and the heavier bottom end, due to gravity, holds it against the users body. The users hands are mostly in touch with the tray and food thus preventing any undue side-to-side movement.

SUMMARY, RAMIFICATIONS, AND SCOPE

Thus, the reader will see that T have provided a folding food tray for hanging around the back of a user's neck, so that when no tables or chairs are available, the user can stand, walk, lean, or kneel, or sit on the ground or floor, and still have his tray securely supported and his hands free for handling his silverware, food, and drink.

I have also provided a hands-free tray which can fold up into a small parcel measuring only 12"×10"×3".

This tray can be made of any lightweight material such as aluminum, plastics, fiberglass, lightweight carbon fibers, polyurethene, or any other suitable material. The parts can be pressed into shape from sheet metal, suction formed, molded, cast, or laminated from fiberglass. It can be used by young and old alike at picnics, barbecues, when camping, when traveling, at parties, or emergency situations.

While the above description contains many specificities, the reader should not construe these as limitations on the scope of the invention, but merely as exemplifications of preferred embodiments thereof. Those skilled in the art will envision that many other possible variations are within its scope. For example, skilled artisans will readily be able to change the dimensions and shapes of the various embodiments, such as by making the parts smaller or larger, or by changing their shapes, or utilizing different hinges, or even by making the parts attachable and removable, or replacing the neck hook with a flexible neck band.

Accordingly, the reader is required to determine the scope of the invention by the appended claims and their legal equivalents, and not by the examples which have been given.

What is claimed is:

1. A neck-supported food tray, comprising:
a breast portion having an upper end and a lower end,
a suspension means for suspending said food tray from the neck of a user, said suspension means being attached to said breast portion proximate said upper end,
at least one clip suitable for holding a napkin, said clip being attached to said breast portion proximate said upper end,
a plate holder pivotally attached to said breast portion proximate said lower end,
and a stop means for holding said plate holder in a position perpendicular to said breast portion.

2. The food tray of claim 1 further comprising a drink holder attached to said breast portion.

3. The food tray of claim 2 wherein said drink holder comprises a ring suitable for holding a drinking glass within said ring.

4. The foods tray of claim 3 wherein said ring is pivotally attached to said breast portion.

5. The food tray of claim 1 wherein said suspension means comprises a hook for engaging the neck of the user, said hook being pivotally attached to said breast portion proximate said upper end.

6. A neck-supported food tray, comprising:
a breast portion having an upper end and a lower end,
a suspension means for suspending said food tray from the neck of a user, said suspension means being attached to said breast portion proximate said upper end.
two arms each having a first end and a second end, said first ends of said arms being pivotally attached to said breast portion proximate said upper end, and said second ends of said arms each having a clip suitable for holding a napkin,
a plate holder pivotally attached to said breast portion proximate said lower end,
and a stop means for holding said plate holder in a position perpendicular to said breast portion.

7. A neck-supported food tray, comprising:
a breast portion having an upper end and a lower end,
a hook for suspending said food tray from the neck of a user, said hook being pivotally attached to said breast portion proximate said upper end,
a plate holder pivotally attached to said breast portion proximate said lower end,
a stop mean for holding said plate holder in a position perpendicular to said breast portion,
a ring pivotally attached to said breast portion, said ring being suitable for holding a drinking glass within said ring,
and two arms each having a first end and a second end, said first ends of said arms being pivotally attached to said breast portion and said second ends of said arms each having a clip suitable for holding a napkin.

* * * * *